US009038776B2

(12) United States Patent
Green et al.

(10) Patent No.: US 9,038,776 B2
(45) Date of Patent: May 26, 2015

(54) COLLAPSIBLE SAFE LADDER

(75) Inventors: Jeffrey Green, Bartlesville, OK (US); Floyd LaVern Vestal, Independence, KS (US)

(73) Assignee: LOCK N CLIMB, LLC, Bartlesville, OK (US)

( * ) Notice: Subject to any disclaimer, the term of this patent is extended or adjusted under 35 U.S.C. 154(b) by 92 days.

(21) Appl. No.: 13/228,054

(22) Filed: Sep. 8, 2011

(65) Prior Publication Data

US 2012/0048647 A1 Mar. 1, 2012

Related U.S. Application Data

(63) Continuation-in-part of application No. 12/877,310, filed on Sep. 8, 2010, now abandoned, which is a continuation-in-part of application No. 12/418,035, filed on Apr. 3, 2009, now Pat. No. 8,485,316.

(51) Int. Cl.

| | |
|---|---|
| ***E06C 7/42*** | (2006.01) |
| ***E06C 1/16*** | (2006.01) |
| *E06C 1/10* | (2006.01) |
| *E06C 7/44* | (2006.01) |
| *E06C 7/46* | (2006.01) |

(52) U.S. Cl.

CPC ..... *E06C 7/423* (2013.01); *Y10T 29/49947* (2015.01); *E06C 7/42* (2013.01); *E06C 1/10* (2013.01); *E06C 1/16* (2013.01); *E06C 7/44* (2013.01); *E06C 7/46* (2013.01)

(58) Field of Classification Search

CPC ..... E06C 7/42; E06C 7/423
USPC ..... 182/107, 108, 109, 111
See application file for complete search history.

(56) References Cited

U.S. PATENT DOCUMENTS

| | | | |
|---|---|---|---|
| 202,426 | A | 4/1878 | Evans |
| 281,977 | A | 7/1883 | Coons |
| 475,935 | A | 5/1892 | Crews |

(Continued)

FOREIGN PATENT DOCUMENTS

| | | | |
|---|---|---|---|
| GB | 2099060 | A | 12/1982 |

OTHER PUBLICATIONS

International Search Report and Opinion for International Application No. PCT/US2011/050882, with a mailing date of Jan. 5, 2012.

(Continued)

*Primary Examiner* — Alvin Chin-Shue
*Assistant Examiner* — Colleen M Chavchavadze
(74) *Attorney, Agent, or Firm* — Michael Stanely Tomsa; Katten Muchin Rosenman LLP

(57) ABSTRACT

A ladder system is disclosed which allows for stabilizing a ladder on multiple surfaces without the need for a second person or a great deal of setup time. The collapsible ladder system includes a larger ladder section and a smaller ladder strut section which are pivotally connected at a point which is at or below the midpoint of the larger ladder section. The larger ladder section and smaller ladder strut section are connected by a rigid adjustable linkage, or spreader, at a point that is below the pivotable connection. The ladder further includes a means for stability on a variety of surfaces. At the ground contact point, the point where the ladder side rail ends and the ground meet, there are adjustable gripping feet, which can be independently or in combination vertically or angularly adjusted for maximum stability.

18 Claims, 13 Drawing Sheets

(56) References Cited

U.S. PATENT DOCUMENTS

| | | | | |
|---|---|---|---|---|
| 515,783 | A | 3/1894 | Moore | |
| 799,782 | A | 9/1905 | Ellinger | |
| 840,365 | A | 1/1907 | Pease | |
| 886,737 | A | 5/1908 | Taylor | |
| 935,306 | A * | 9/1909 | Jennings | 182/129 |
| 1,385,319 | A | 7/1921 | Enke | |
| 1,521,814 | A | 1/1925 | Houska | |
| 1,811,722 | A | 6/1931 | Kimberlin | |
| 1,812,119 | A | 6/1931 | Ruse | |
| 2,007,057 | A | 7/1935 | McNeal | |
| 2,129,401 | A | 9/1938 | Botinger et al. | |
| 2,471,110 | A | 5/1949 | Jenkins | |
| 2,574,286 | A | 11/1951 | Rein | |
| 2,584,197 | A | 2/1952 | Garner | |
| 2,887,260 | A | 5/1959 | McKinnie | |
| 2,934,163 | A | 4/1960 | Laweski | |
| 3,288,248 | A | 11/1966 | Gurian et al. | |
| 3,374,860 | A * | 3/1968 | Stewart | 182/204 |
| 3,508,628 | A | 4/1970 | Conrad | |
| 3,768,592 | A | 10/1973 | Higgins | |
| 3,933,221 | A | 1/1976 | Sorenson | |
| 4,069,893 | A | 1/1978 | Blackstone | |
| 4,147,231 | A | 4/1979 | Chantler et al. | |
| 4,207,886 | A | 6/1980 | Sorenson | |
| 4,244,446 | A | 1/1981 | Mair | |
| 4,483,415 | A | 11/1984 | Disston et al. | |
| 4,520,896 | A | 6/1985 | Disston | |
| 4,565,262 | A | 1/1986 | Hawkins | |
| 4,569,419 | A | 2/1986 | Stoltz | |
| 4,669,576 | A | 6/1987 | Jones | |
| 4,723,629 | A | 2/1988 | Vanden Hoek et al. | |
| D295,222 | S | 4/1988 | Rudolph | |
| 4,798,262 | A | 1/1989 | Margolies | |
| 4,807,720 | A * | 2/1989 | Kim | 182/205 |
| 4,899,849 | A | 2/1990 | Levi et al. | |
| 4,949,809 | A | 8/1990 | Levi et al. | |
| 4,971,167 | A | 11/1990 | Winnard | |
| 5,033,584 | A | 7/1991 | Battle | |
| 5,086,876 | A | 2/1992 | Severson | |
| 5,112,043 | A | 5/1992 | Golfillian, Jr. | |
| 5,165,501 | A | 11/1992 | Donahey | |
| 5,195,610 | A | 3/1993 | Chang | |
| 5,267,631 | A | 12/1993 | Mendel | |
| 5,335,754 | A | 8/1994 | Gibson | |
| 5,341,899 | A | 8/1994 | Casamento | |
| 5,370,204 | A | 12/1994 | Fox | |
| D359,366 | S | 6/1995 | Spevak | |
| 5,423,397 | A | 6/1995 | Boughner | |
| 5,507,364 | A | 4/1996 | Spevak | |
| 5,522,473 | A | 6/1996 | Moselsky | |
| 5,551,529 | A | 9/1996 | Molitor | |
| 5,590,739 | A | 1/1997 | High et al. | |
| 5,752,581 | A | 5/1998 | Orchowski | |
| 6,382,353 | B2 | 5/2002 | Laug | |
| 6,450,290 | B1 | 9/2002 | Spak | |
| 6,533,071 | B1 | 3/2003 | Smith | |
| D485,369 | S | 1/2004 | Ranagan et al. | |
| 6,672,427 | B1 * | 1/2004 | Sheffield | 182/172 |
| 6,948,591 | B2 | 9/2005 | Scott et al. | |
| 6,959,785 | B1 | 11/2005 | Chilton | |
| 7,163,084 | B1 | 1/2007 | Blehm | |
| 7,293,630 | B1 | 11/2007 | Trebec | |
| D576,290 | S | 9/2008 | Meyers et al. | |
| D610,709 | S | 2/2010 | Lamb | |
| 8,002,084 | B2 | 8/2011 | Huang | |
| 8,127,890 | B2 | 3/2012 | Meyers et al. | |
| 8,640,827 | B2 | 2/2014 | Breithaupt, Jr. | |
| 2001/0015303 | A1 | 8/2001 | Laug | |
| 2007/0181370 | A1 | 8/2007 | Kemp-Banks | |
| 2007/0261918 | A1 | 11/2007 | Trebec | |
| 2008/0000720 | A1 | 1/2008 | Porch et al. | |
| 2009/0045013 | A1 | 2/2009 | McMurray | |
| 2009/0107765 | A1 | 4/2009 | Germond | |
| 2010/0147623 | A1 | 6/2010 | Pocos | |
| 2010/0300805 | A1 | 12/2010 | Moss et al. | |
| 2011/0067954 | A1 | 3/2011 | Deal | |

OTHER PUBLICATIONS

PCT/US10/29606-International Bureau preliminary report on patentability dated Oct. 13, 2011.
PCT/US10/29606-ISR dated May 21, 2010.

* cited by examiner

COLLAPSIBLE SAFE LADDER

CROSS-REFERENCE TO RELATED APPLICATIONS

This application is a continuation-in-part of U.S. patent application Ser. No. 12/877,310, filed on Sep. 8, 2010, entitled "Collapsible Safe Ladder," which is a continuation-in-part of U.S. patent application Ser. No. 12/418,035, filed on Apr. 3, 2009, entitled "Collapsible Safe Ladder," both by Floyd LaVern Vestal and Jeffrey Alan Green, hereby incorporated by reference.

BACKGROUND

Ladders have the problem that when in use, they are generally unstable. This lack of stability will often lead to injury or even death. Indeed, injuries related to ladder use are a leading problem in construction, repair and other industries. Until now, the most common way to remedy an unstable ladder was to require a second person to be positioned at the base of the ladder, or to construct a form of scaffolding, which is both costly and time-consuming.

Numerous modifications have been made to ladders over the years, including, for example, U.S. Pat. Nos. 202,426; 281,977; 515,783; 886,737; 1,812,119; 1,811,722; 2,007,057; 2,471,110; 2,584,197; 2,887,260; 2,934,163; 3,288,248; 3,374,860; 4,520,896; 4,565,262; 4,669,576; 5,033,584; 5,086,876; 5,165,501; 5,590,739 and U.S. Publication Number 2010/0147623. However, a need still exists for an easy-to-use, collapsible multi-surface, self-supporting ladder and ladder system with increased stability that does not require a second person or unnecessary assembly time. One aspect of the present disclosure is to provide a configuration that will help prevent injuries for individuals who climb, work on, dismount from or do any other work involving a ladder. It is contemplated that the exemplary embodiments disclosed below can be used on, inter alia, an extension ladder, pull-down attic ladder, one-piece straight ladder or any other ladder where additional stability is needed.

SUMMARY

The present disclosure endeavors to provide a collapsible multi-surface, self-supporting ladder and ladder system with an increased stability that does not require a second person or unnecessary assembly time.

According to a first aspect of the present invention, an apparatus for stabilizing a ladder comprises (i) two or more substantially parallel support rails, each support rail having a first end and a second end; (ii) one or more longitudal cross members connecting said substantially parallel support rails; (iii) a rod for pivotally attaching the first end of each substantially parallel support rail to a ladder, wherein said rod, which has a first end and a second end, is configured to be inserted through a hollow ladder rung such that the first and second ends protrude on each side of the hollow ladder rung for enabling the first end of each substantially parallel support rail to be removably attached to a rod end; (iv) one or more spreaders having a first end and a second end being configured to fold at a point approximately half way between the first and second ends, wherein the first end of each spreader is connected to one of the substantially parallel support rails and the second end is configured to be attached to a ladder; and (v) an adjustable shaft located at the second end of each support rail.

According to a second aspect of the present invention, a method for stabilizing a ladder comprises (i) connecting two support rails using one or more longitudal cross members such that the two support rails are substantially parallel, wherein each support rail has a first end, a second end and an adjustable shaft located at the second end; (ii) inserting a rod through a hollow ladder rung such that the rod's first and second ends protrude from each side of the ladder rung; (iii) pivotally connecting the first end of each substantially parallel support rail to an end of said rod; and (iv) connecting one or more spreaders between said support rails and one or more ladder rails.

According to a third aspect of the present invention, a ladder system comprises (i) two or more substantially parallel support rails, each support rail having a first end and a second end, wherein each support rail includes a bend at a point between the first end and a midpoint that is approximately halfway between the first and second ends; (ii) one or more longitudal cross members connecting said substantially parallel support rails; (iii) a rod for pivotally attaching the first end of each substantially parallel support rail to a ladder, wherein said rod, which has a first end and a second end, is configured to be inserted through a hollow ladder rung such that the first and second ends protrude on each side of the hollow ladder rung for enabling the first end of each substantially parallel support rail to be removably attached to a rod end; (iv) one or more spreaders having a first end and a second end and configured to fold at a point approximately halfway between the first and second ends, wherein the first end of each spreader is connected to one of the substantially parallel support rails and the second end is configured to be attached to a ladder; and (v) an adjustable spring-loaded shaft located at the second end of each support rail, wherein the shaft includes a shoe at the ground contact point.

In certain aspects of the present invention, a second rod may be provided for pivotally attaching the second end of each spreader to a ladder.

In other aspects of the present invention, said adjustable shaft may be spring-loaded and/or include a shoe at the ground contact point, wherein each shoe may have a gripping material to prevent slippage at the ground contact point and may further comprise a kick peg.

In another aspect of the present invention, each substantially parallel support rail may constructed from a single, continuous material. Each substantially parallel support rail may be constructed from a metal or metal alloy.

In yet another aspect of the present invention, each substantially parallel support rail may include a bend at a point between the first end and a midpoint which is approximately halfway between the first and second ends.

DESCRIPTION OF THE DRAWINGS

These and other advantages of the present invention will be readily understood with reference to the following specifications and attached drawings wherein.

DETAILED DESCRIPTION

Preferred embodiments of the present invention will be described hereinbelow with references to the accompanying drawings. In the following description, well-known functions or constructions are not described in detail, since such minutia would obscure the invention in unnecessary trivia.

Figure 1:
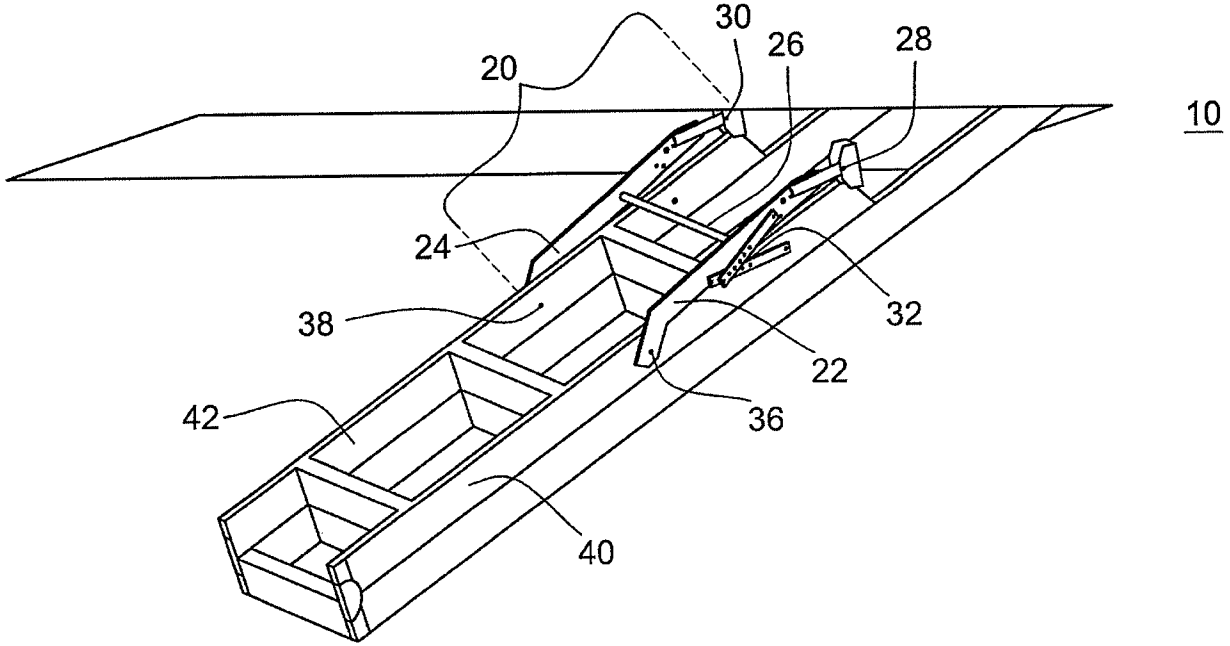
FIG. 1 is a front angular perspective view of a first embodiment of a ladder system of the present invention mounted on a pull-down ladder in the collapsed position.

Referring to FIG. 1, an embodiment of the ladder system 20 mounted to pull-down ladder 10 in a partially collapsed state is depicted. The ladder system 20, or smaller strut section, includes a pair of support rails 22, 24 substantially identical but of opposite hand, a lateral cross member strut 26, a pair of adjustable feet 28, 30 substantially identical but of opposite hand, and a pair of rigid adjustable spreaders 32, 34 substantially identical but of opposite hand.

Figure 2:
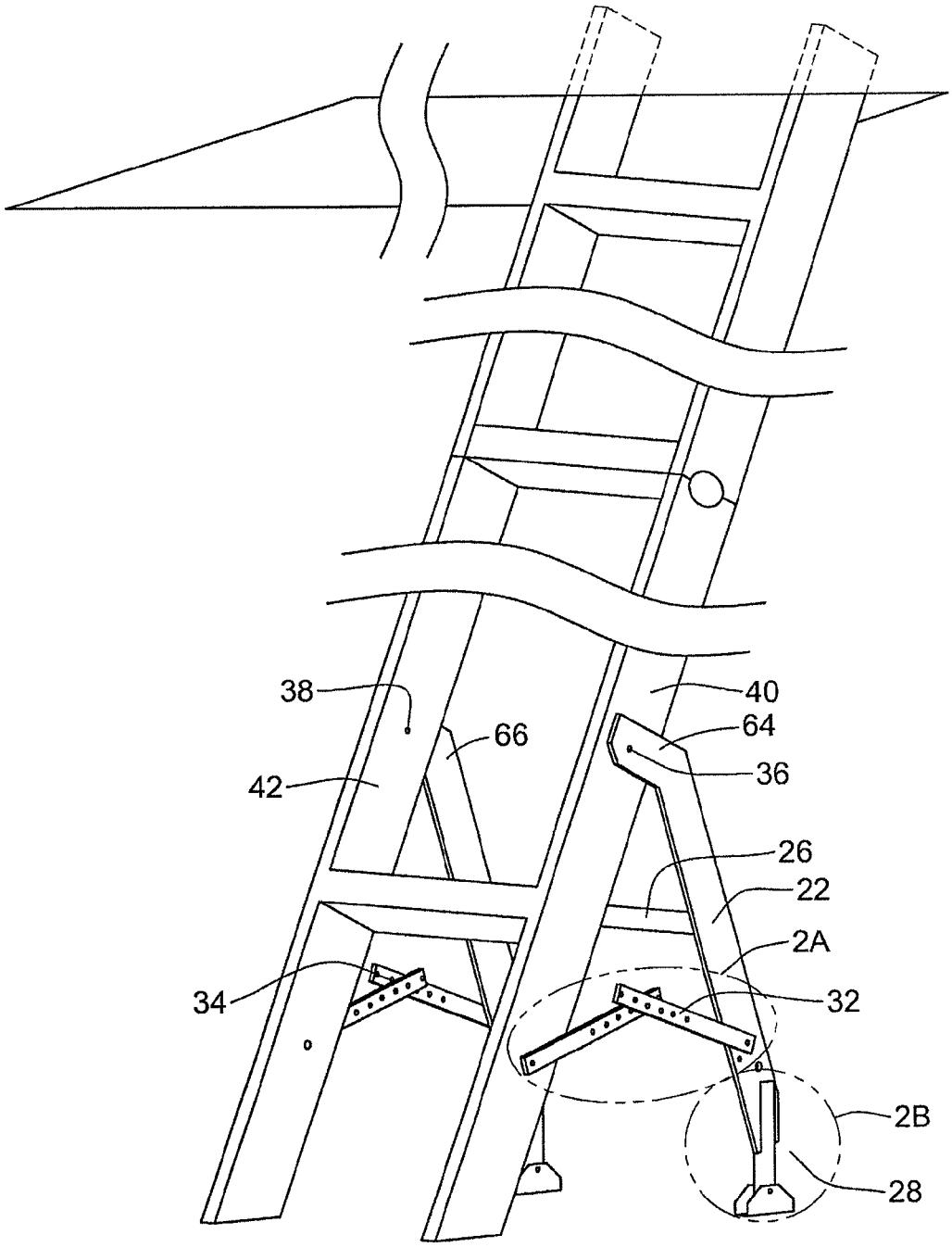
FIG. 2 is a front angular perspective view of the first embodiment of a ladder system of the present invention mounted on a pull-down attic ladder in the extended position.
Figure 11A:
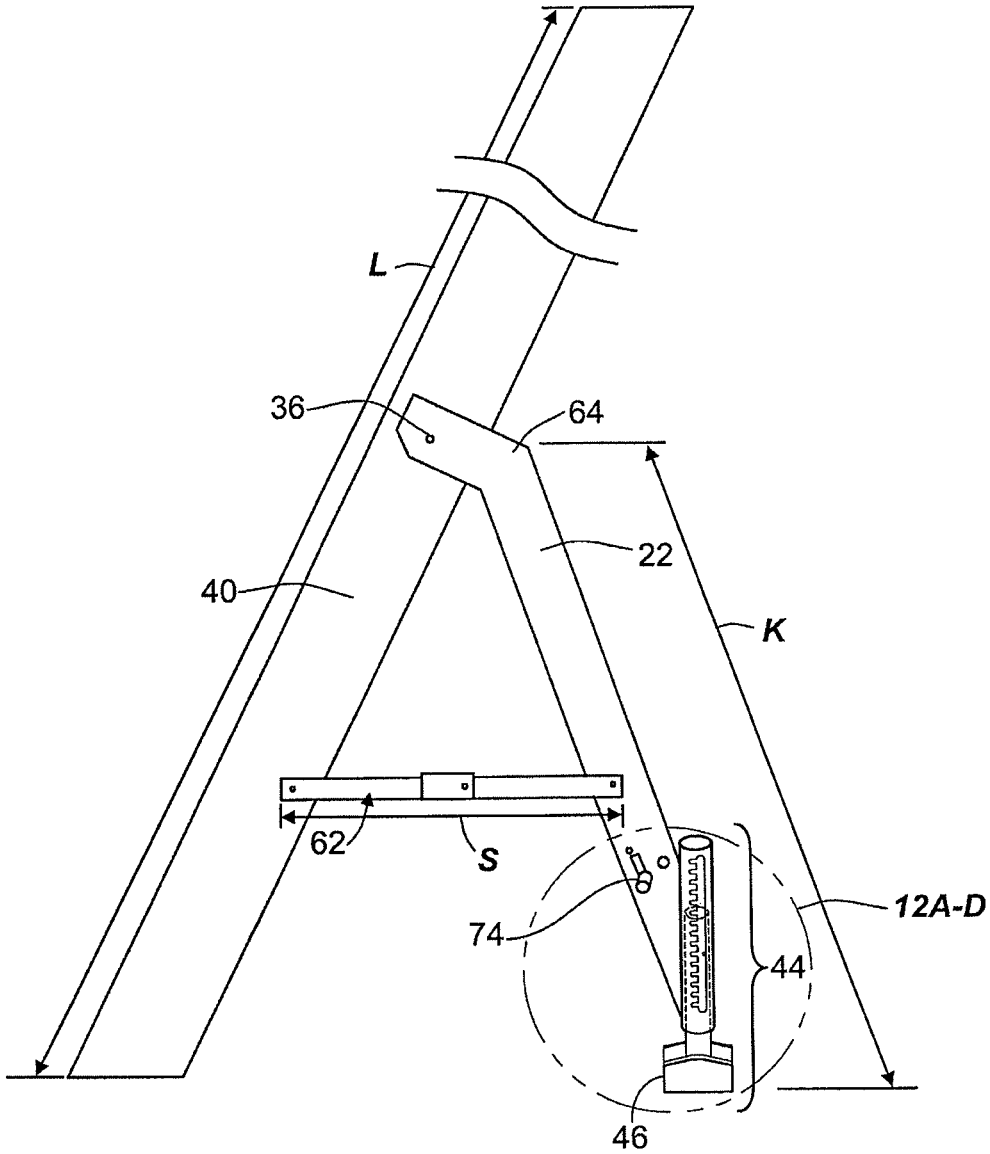
FIG. 11A is a side view of the ladder system with a spring-loaded adjustable foot where the fixed spreader is in a locked extended position.
Figure 11B:
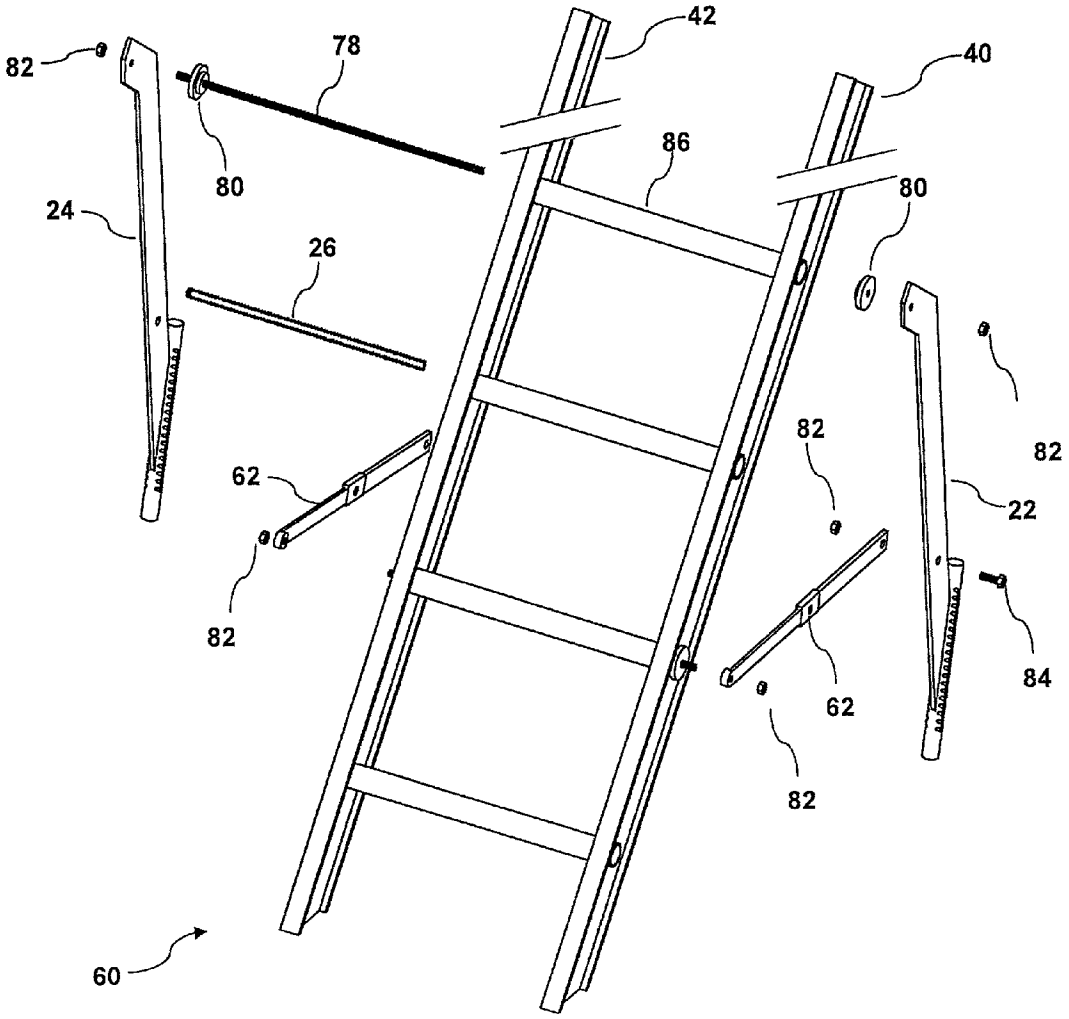
FIGS. 11B-E illustrate a ladder system having a spring-loaded adjustable foot wherein the ladder system is removably attached to a ladder.
Figure 11D:
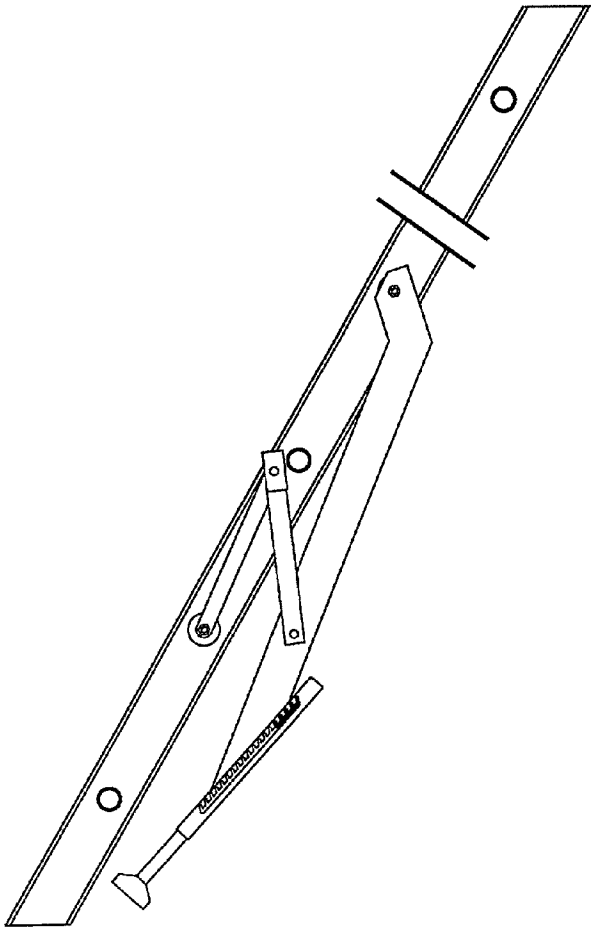
Figure 11C:
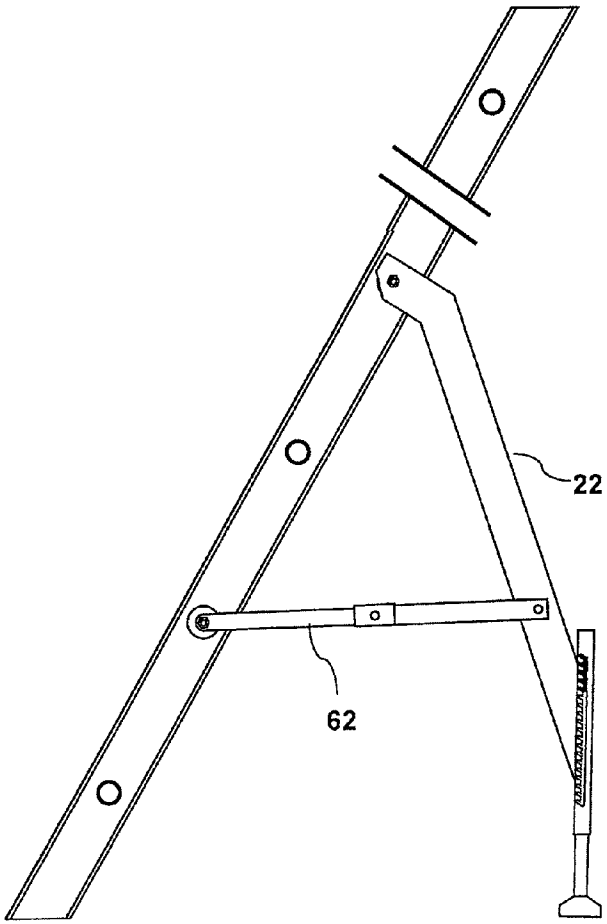

Referring now to FIG. 2, the ladder system of FIG. 1 is shown fully extended. In this embodiment, the support rails 22, 24 are substantially parallel, however in an alternative embodiment the rails 22, 24 may be outwardly flared at their lower ends to create a wider stance, allowing for increased stability. In either embodiment, each of the rails 22, 24 has a foot 28, 30 located at the end of the rail 22, 24 where contact is made with the ground, referred to as the ground contacting point, while the opposite end of each of the rail 22, 24 is pivotally connected, using pivotal connectors 36, 38, to its respective rails 40, 42 of the pull-down ladder 10. The pivotal connectors 36, 38 can be either permanently connected by means of a bolt, rivet, pivoting hinge, etc. or alternatively, the pivotal connection can be removably attached to the rails 40, 42 of the pull-down ladder 10 by means of, for example, a clamping structure, allowing the ladder system to be used on a multitude of preexisting ladders, including, for example, drop-down and extension ladders. As will be described in greater detail below, an exemplary method for removably attaching each rail 22, 24 to its respective rail 40, 42 is illustrated in FIGS. 11B and 11C.

Figure 2A:
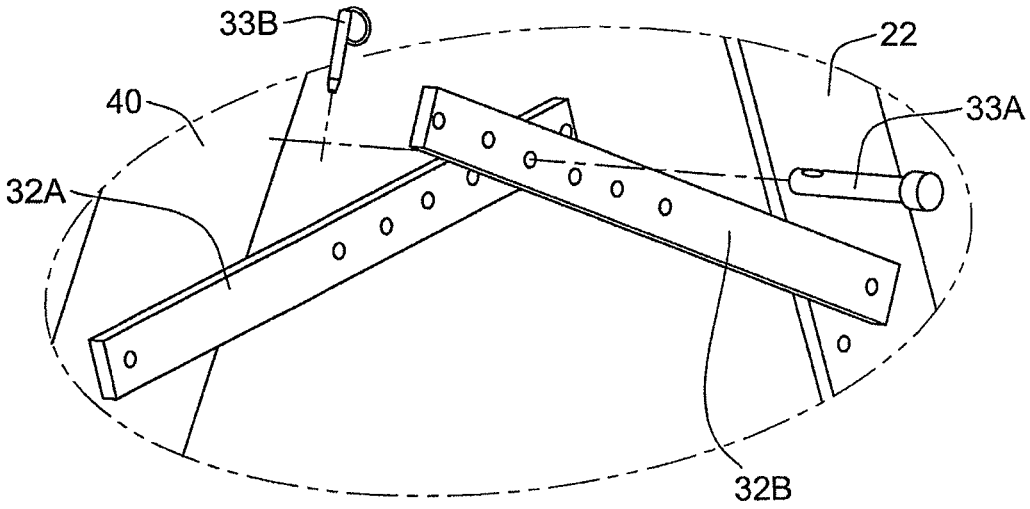
FIG. 2A is an exploded view of the adjustable spreader of the ladder system in FIG. 2.

Referring to FIG. 2A, an exploded view of an adjustable spreader of the ladder system, the depicted rigid adjustable spreader 32, 34 is generally composed of two rigid spans 32*a*, 32*b* that are pivotally connected at their ends with a shank 33*a* and lock pin 33*b* such that the two rigid spans 32*a*, 32*b* can lock in the fully extended position to form a spreader between the rails 22, 24 in the lower section, between the midpoint of the ladder rail length and the ground contact points, of their respective rails 40, 42 of the pull-down ladder 10. In other embodiments, an extension ladder or step-to-straight ladder may be stabilized in lieu of a pull-down ladder. For example, when applied to a 28-foot extension ladder, the rigid span, or spreader, is connected to the existing ladder approximately 17 inches (nearly 1/20th the total length of the ladder) off the ground. The pivotal connection may be laterally adjustable such that the length of the spreader can be increased or decreased thereby increasing or decreasing the angle created between the ladder system rails 22, 24 and their respective rails 40, 42 of the pull-down ladder 10. In certain embodiments, as seen in FIG. 11A, the spreader may a standard spreader 62 with a fixed length S as used in a traditional step ladders. The length S of the fixed spreader is determined based on the total length L of ladder being stabilized and the desired base or footprint size. For example, in a preferred embodiment using a standard spreader 62, the spreader's 62 total length S, when applied to a 28-foot extension ladder, may be approximately 24 inches. The approximately 24-inch spreader may, however, be used for a range of ladder sizes (e.g., 24' to 40-foot extension ladders). For smaller ladders (e.g., a 16-foot extension or step-to-straight ladder) a spreader length S of approximately 18 to 19 inches would be preferred. Naturally, various spreader lengths S may be used depending on the application and length L of the ladder (e.g., a longer spreader may be used for longer ladders which may require a larger footprint or base). As seen in the figures, the rails 22, 24 may be predrilled with more than one set of holes near the shaft 44 so that a single fixed length spreader 62 may be used with a number of ladders lengths and sizes by simply installing the spreader 62 at different locations on the rails 22, 24.

Figure 7:
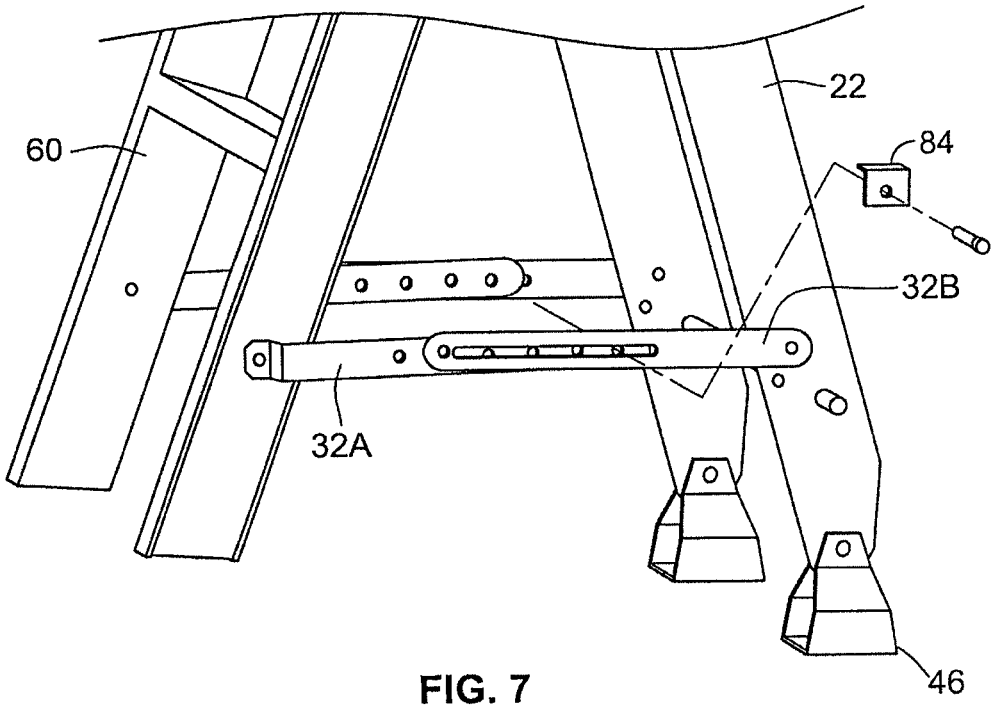
FIG. 7 is a side view of the ladder system showing the spreader in a locked extended position.

Referring to FIG. 7, another means for connecting two rigid spans 32A, 32B is shown. The two rigid spans 32A, 32B are connected to one another at two points, with a pen anent laterally slideable connection and a second connection that locks the span at the specified length using the safety stop 84 and a pin 33A that penetrates the hole of the safety stop 84 and the desired hole in the rigid span 32B therefore locking the overall length of the spreaders 32, 34. When the pin 33A is not in the safety stop 84, the spreader can be folded at the slideable connection. To prevent misplacement, the pin 33A may be tethered to the ladder or ladder system 20. In an alternative embodiment, there may be more than two rigid spans comprising the spreader, and the connection between the at least two rigid spans can be by another means, including, but not limited to, a threaded post and wing nut or screw caps 50.

Figure 2B:
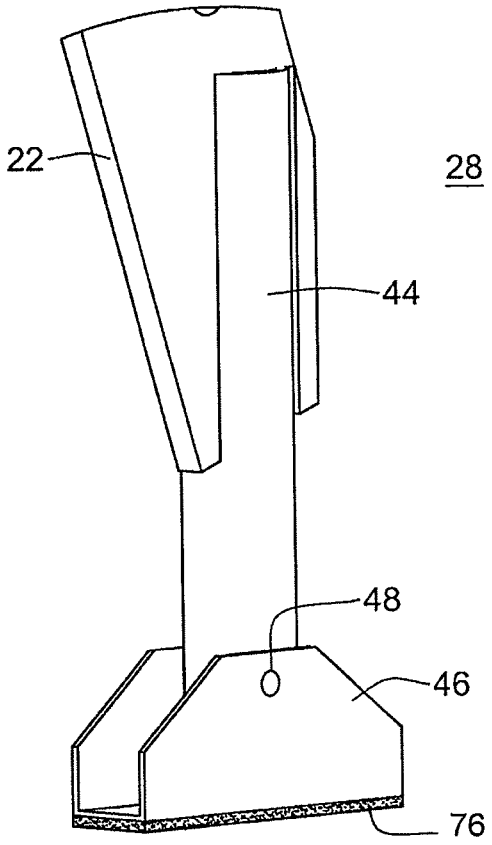
FIG. 2B is an exploded view of the adjustable foot of the ladder system in FIG. 2.

Referring to FIG. 2B, an exploded view of a ladder system foot 28 is shown. The feet 28, 30, located at the end of the rails 22, 24 at the ground contact point, are both angularly and vertically adjustable. Each of said feet 28, 30 is composed of two primary components, a vertically extendable shaft 44 and shoe 46 pivotally connected to the shaft 44 using a pivotal connector 48. The pivotal connector 48 allows the shoe 46 to conform to the angle of the ground on which it is placed. If required, the pivotal connector 48 can be tightened, therefore locking the shoe 46 in the preferred arrangement. The length of the rails 22, 24 depends on the application of the ladder system. When stabilizing a shorter ladder, the rails 22, 24 may be shorter than rails 22, 24 being used to stabilize a longer ladder, or when a larger foot-print or base is needed for stabilizing a ladder. For example, when a ladder having a length L of 6 to 23 feet (e.g., a 16-foot extension ladder or step-straight ladder) is used, the rails 22, 24 may be approximately 21 inches in length K from the foot-end to the bent portion 64 of the rails 22, 24. Similarly, when a ladder having a length L of 24 to 40 feet (e.g., a 28-foot extension ladder) is used, the rails 22, 24 may be approximately 30 inches in length K from the foot-end to the bent portion of the rails 22, 24. Naturally, the length K of the rails 22, 24 may vary from the provided measurements.

Figure 9:
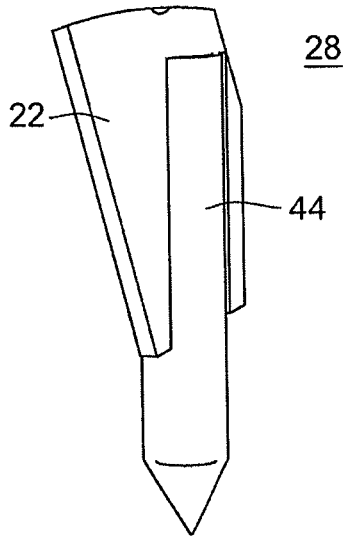
FIG. 9 shows an alternative foot where the shaft forms a spike.

The underside of the shoe 46 includes a gripping material 76 to minimize slippage at the ground contact point. Depending on the application, said gripping material 76 could be a rubber pad for use on a relatively smooth hard surface, spiked (as seen in FIG. 9) or staggered for use on grass and packed dirt, or even a planar foot that creates a large shoe surface area, therefore preventing the foot 28, 30 from sinking into soft ground. Depending on the choice of shoe 46, the ladder system 20 can be used on ground surfaces such as concrete, dirt, steel, tile, grating, brick, stone and most floor materials. The pivotable connector 48 between the shaft 44 and shoe 46 may be permanent or removable, therefore allowing one to interchange the shoe 46 depending on the application or environment.

Figure 8:
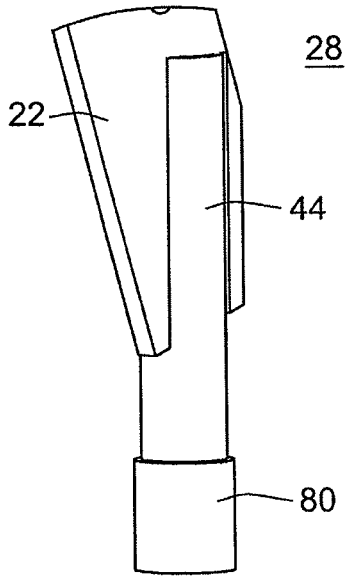
FIG. 8 shows an alternative foot with a rubber boot.

Alternative foot embodiments are shown in FIG. 7 wherein the shoe 46 is directly coupled to the end of the rails 22, 24 and FIG. 8 wherein the shaft 44 comes into direct contact with the ground or through an optional intermediate such as a rubber boot 80. The rubber boot 80 acts as a gripping material and prevents the shaft 44 from scratching the ground. Referring now to FIG. 9, in lieu of a rubber boot 80, the end of the shaft 44 may be pointed to increase ground penetration, therefore preventing slippage on dense penetrable surfaces such as dirt, grass, gravel and rock.

Figure 3A:
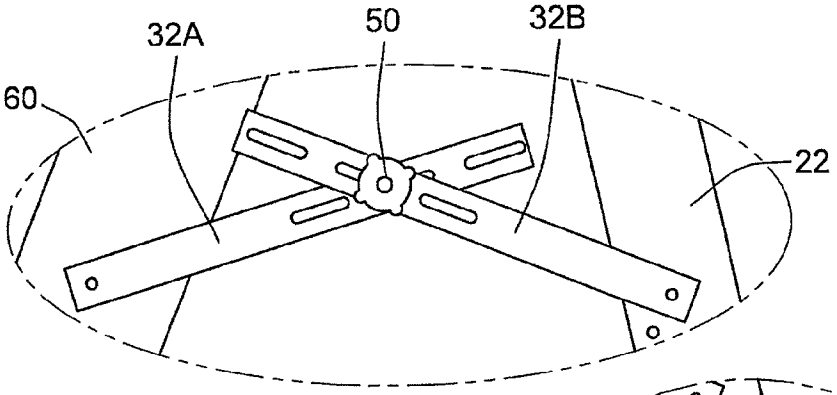
FIG. 3A is an exploded view of the adjustable spreader of the ladder system in FIG. 3.
Figure 3B:
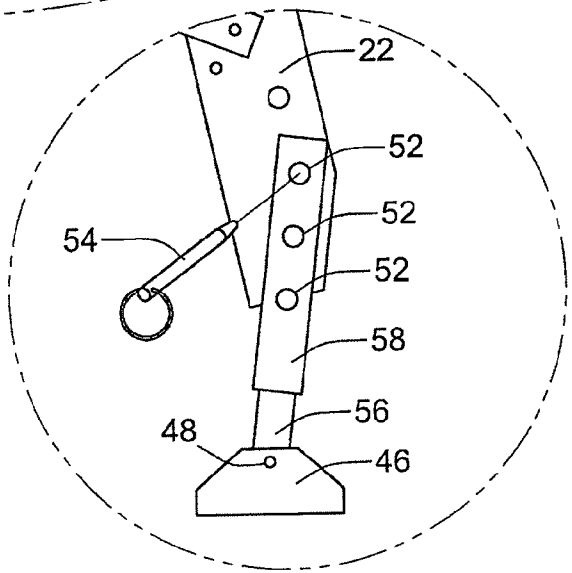
FIG. 3B is an exploded view of the adjustable foot of the ladder system in FIG. 3.
Figure 3:
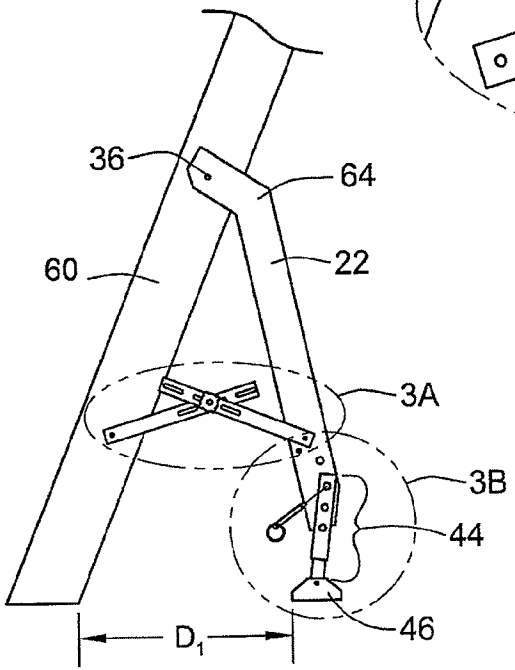
FIG. 3 is a side angular perspective view of a second embodiment of the adjustable ladder system of the present invention mounted on an extension ladder.
Figure 4A:
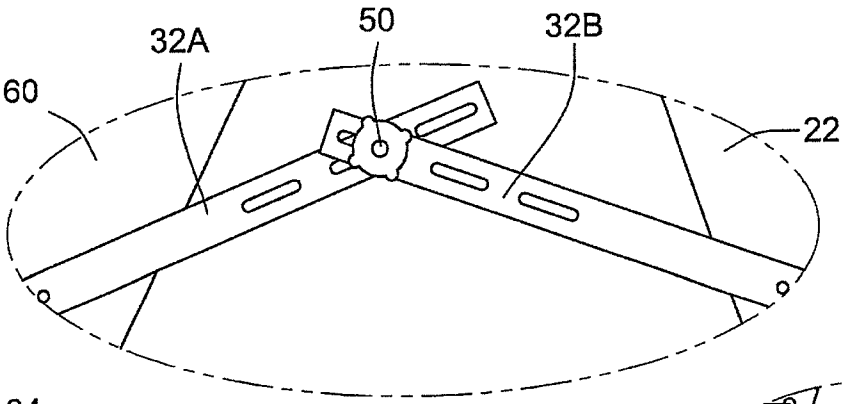
FIG. 4A is an exploded view of the adjustable spreader of the ladder system in FIG. 4.
Figure 4B:
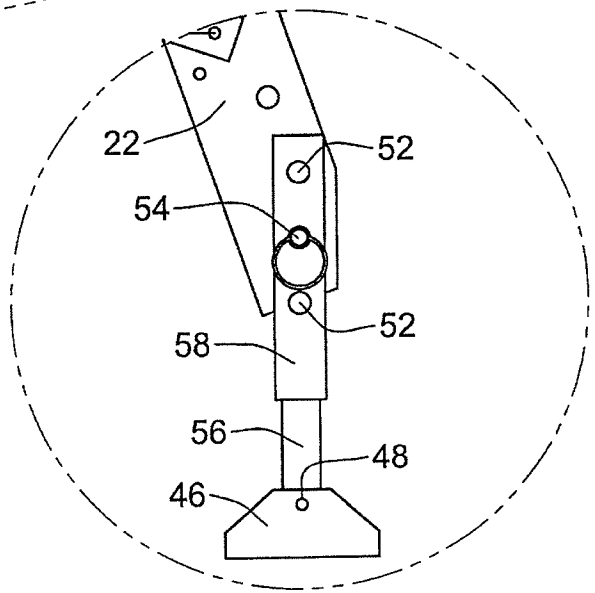
FIG. 4B is an exploded view of the adjustable foot of the ladder system in FIG. 4.
Figure 4:
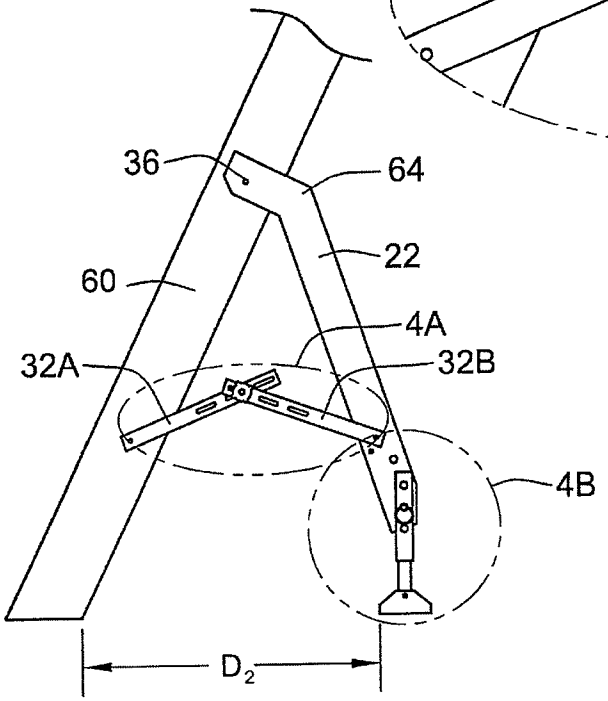
FIG. 4 is a side angular perspective view of a second embodiment of the adjustable ladder system of the present invention mounted on an extension ladder set up to allow for a greater ground footprint.
Figure 5A:
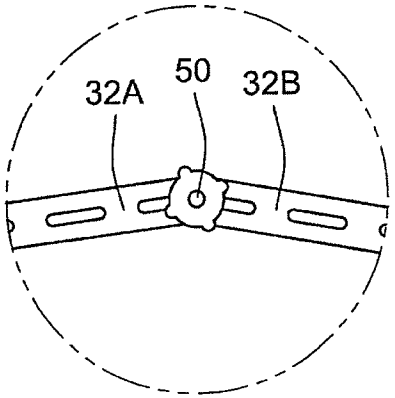
FIG. 5A is an exploded view of the fully extended adjustable spreader of the ladder system in FIG. 5.
Figure 5B:
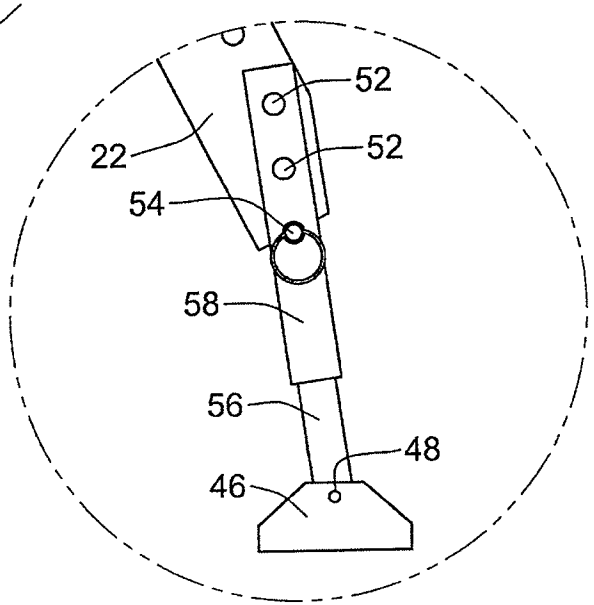
FIG. 5B is an exploded view of the adjustable foot of the ladder system in FIG. 5.
Figure 5:
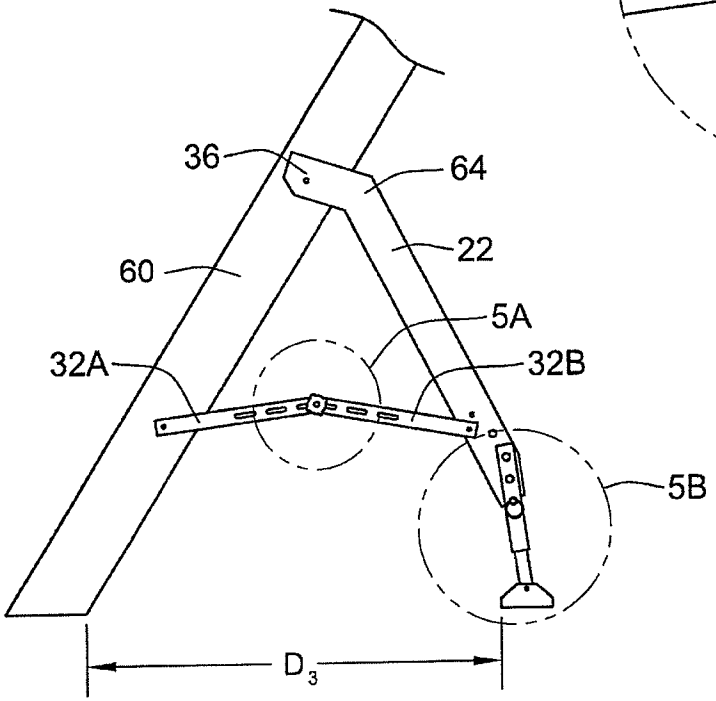
FIG. 5 is a side angular perspective view of a second embodiment of the adjustable ladder system of the present invention mounted on an extension ladder set up to allow for a maximum ground footprint.
Figure 6:
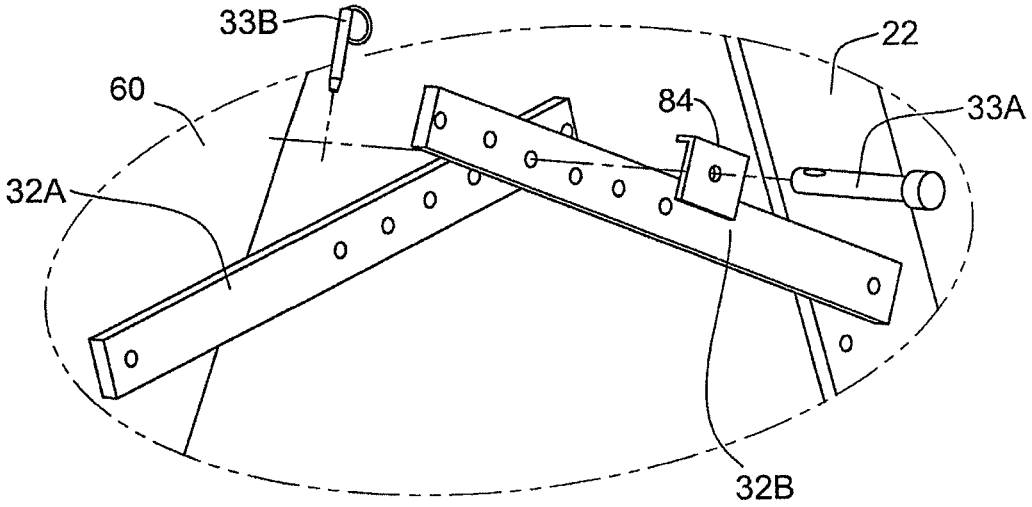
FIG. 6 is an exploded view of a partially extended adjustable spreader of the ladder system.

Referring now to FIGS. 3-5, in this embodiment, a side view of the ladder system's versatility is shown when the ladder system 20 is installed on a traditional straight ladder 60; however, the system is not restricted to a straight ladder but can be applied to any ladder where additional stability is required. FIGS. 3-5 show three adjustment configurations where the rigid adjustable spreaders 32, 34 have been laterally adjusted to create a larger overall footprint by increasing the distance between the larger ladder section 60 and the ladder system 20, the shaft 44 is vertically adjusted to ensure that steady contact between the shoe 46 and the ground is maintained, and the shoe 46 adapts to the angle and terrain of the ground. The shaft 44 as shown in FIGS. 3B, 4B and 5B is adjusted using two nested tubes 56, 58 with a plurality of holes 52 which, when adjusted to the appropriate height, can be aligned and locked into place using a set pin 54. In alternative embodiments, a push-button adjustment mechanism with or without a locking ring may be used to secure the two nested tubes 56, 58, the nested tubes 56, 58 may be locked at a specified length with a slip nut and washer or the two nested tubes 56, 58 may be threadedly coupled wherein the overall shaft 44 is extended or shortened by rotating the shoe 46 and/or lower nested tube 56. In another embodiment, as depicted in FIGS. 12A-12D, the nested tubes 56, 58 may be spring-loaded. This may be accomplished, for example, using a spring 68 and series of notches 70, or grooves, to quickly and safely adjust the height of the shaft. The upper nested tube 58 includes a series of angled notches 70 configured to receive one or more pegs 72. The lower nested tube 56 would include one or more pegs 72 which may be received by the angled notches 70 in the upper nested tube 58. A spring 68 is housed in the hollow space within the nested tubes 56, 58 and creates a constant force pulling the tube ends toward each one another in direction B, therefore shortening the shaft 44. To make adjustments to the shaft's 44 length, a user could twist the foot 46 and/or lower nested tube 56 in direction C so that the one or more pegs 72 is withdrawn from one or more angled notches 70. The user may then pull the foot 46 and/or lower nested tube 56 in direction A until the desired shaft 44 length has been reached. Once the desired length has been reached, the user twists the foot 46 and/or lower nested tube 56 in direction D causing the one or more pegs 72 to be inserted into the one or more angled grooves 70. The tension created by the spring 68 pulls nested tube 56 in direction B and securely holds the one or more pegs 72 in the one or more angled grooves 70. When weight is applied to the ladder or shaft 44, a force is created in direction B that further secures the one or more pegs 72 in the one or more angled grooves 70 to prevent collapsing and/or shortening of the shaft 44.

Figure 11E:
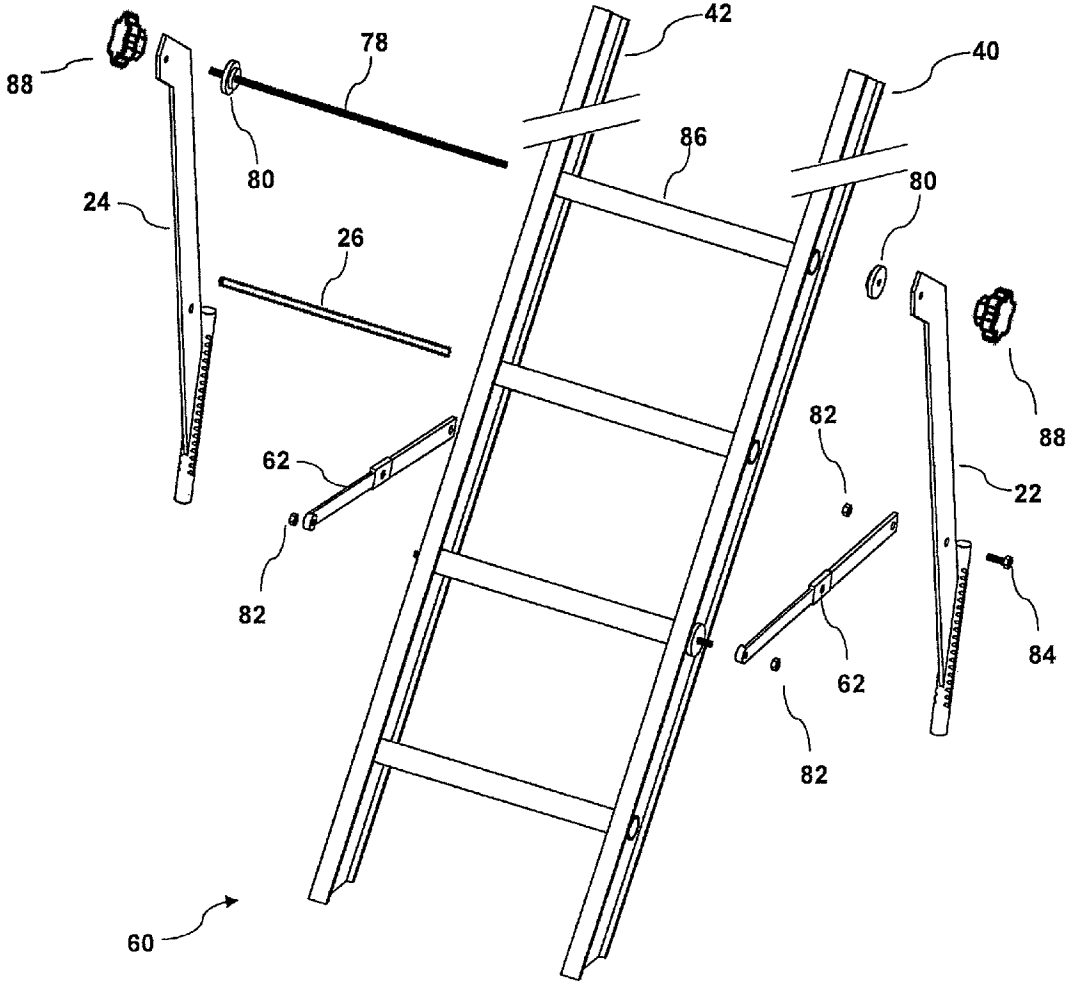
Figure 12A:
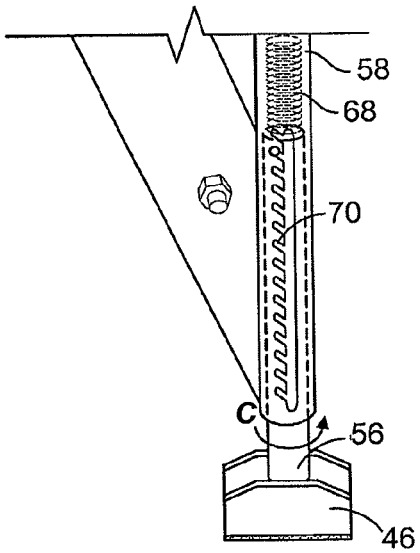
FIGS. 12A-D are exploded views of the operation of the spring-loaded adjustable foot of the ladder system of FIGS. 11A-D.
Figure 12B:
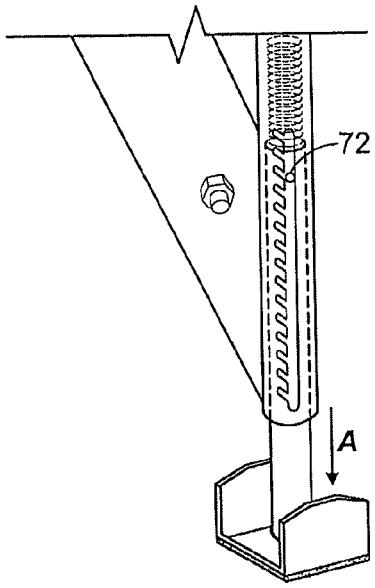
Figure 12C:
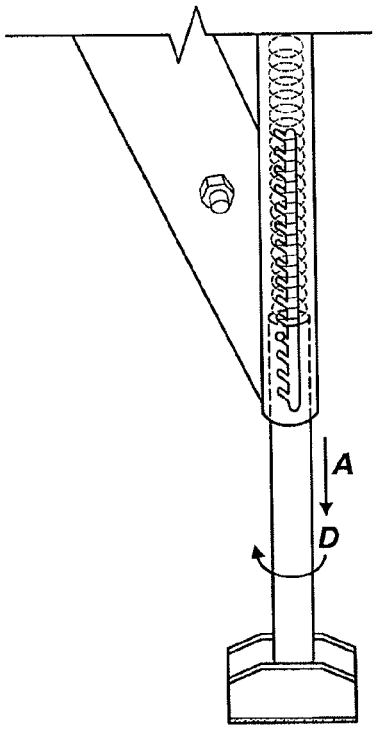
Figure 12D:
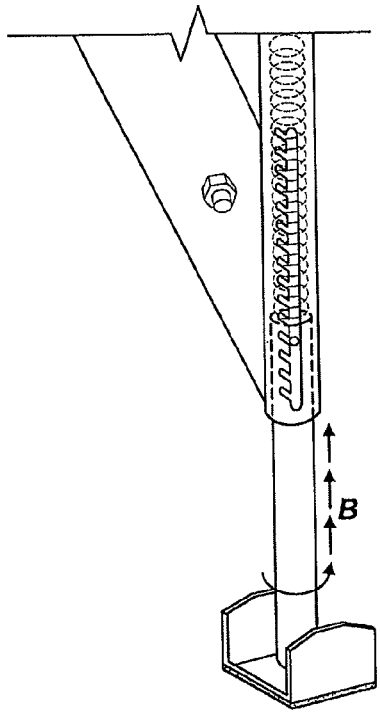

Turning now to FIG. 11B, a technique for removably attaching each rail 22, 24 to its respective rail 40, 42 is illustrated. In certain situations, it may be advantageous to removably attach each rail 22, 24 to a ladder without drilling or otherwise modifying the original ladder structure. In fact, certain ladder manufactures may prohibit the drilling of holes though a ladder rail alleging that it could weaken the structural integrity of the ladder. While this may not necessarily be true, the ladder manufacturer may nevertheless void the warranty. Therefore, to circumvent the risk of voiding a manufacturer warranty, a user may wish to safely attach a ladder system without requiring any modifications to the original ladder. This may be accomplished by, for instance, inserting a rod 78 through the hollow rung 86 of a ladder 60. In order to receive a nut 82, the rod 78 may be threaded at the ends or, in the alternative, threaded across the entire length of the rod 78. In order to reduce friction and/or prevent the rod 78 from becoming misaligned during use, a bushing 80 may be inserted on each end of the rod 78 such that, when assembled, a bushing 80 is located between each ladder 60 rail 40, 42 and the corresponding ladder system rail 22, 24. The bushing 80 may be fabricated from any material known in the art of bushing manufacture, including, for example, polyacetal, nylon, fiberglass and/or metallic materials. As illustrated in the FIG. 11B, the bushing 80 may be configured with two different outer diameters, wherein the narrower diameter may be configured to snugly fit within the end of the hollow rung 86 while the second larger diameter would ensure that the bushing 80 remains at the rail 40, 42 surface. Once the bushings 80 have been installed, the rails 22, 24 may be mounted on the rod 78 ends and secured using, for example, a nut 82. The nut 82 may be a traditional nut or a nut design to prevent loosening (e.g., a lock nut). Alternatively, as seen in FIG. 11E, to ease tightening and loosening (e.g., during assemble, disassembly and adjustment), the rails 22, 24 may be mounted on the rod 78 ends and secured using a threaded knob 88. As seen in both FIGS. 11B and 11E, the spreader 62 may be attached to the ladder 60 using the same through-the-rung techniques as those used to attached the rails 22, 24. Alternatively, the spreaders 62 may be attached using more traditional methods, such as traditional nuts 82 and bolts 84.

While the ladder system illustrated in FIG. 11B presents an exemplary method for removeably attaching each rail 22, 24 to a ladder without drilling or otherwise modifying the original ladder, it should be appreciated that one having ordinary skill in the art will recognize that various changes and modifications of the embodiments described herein can be made without departing from the scope and spirit of the invention. Turning now to FIGS. 11C and 11D, the ladder system of FIG. 11B is shown fully assembled. FIG. 11C illustrates the ladder system in a fully extended state while FIG. 11D illustrates the ladder system in a folded state. FIG. 11E illustrates the ladder system of FIG. 11B wherein a threaded knob 88 is used. One or more threaded knobs 88 may be use in conjunction with, or in lieu of nut 82, where the threaded knobs 88 and nut 82 may be interchanged as desired by the user. For example, as illustrated in FIG. 11E, the user may wish to secure the spreader using a nut 82, but may prefer to use a knob 88 to secure each rail 22, 24. Similarly, in certain embodiments, a user may wish to use a knob 88 on only one end while the other of the rod 78 is secured using a nut 82 or a more permanent means such as welding a nut or bushing to the rod 78. The knob 88 may be fabricated from any material known in the art of knob manufacture, including, for example, polyacetal, nylon and/or metallic materials. To enable coupling with a rod 78, the knob 88 is preferably threaded to receive the threads of the rod 78.

Figure 10:
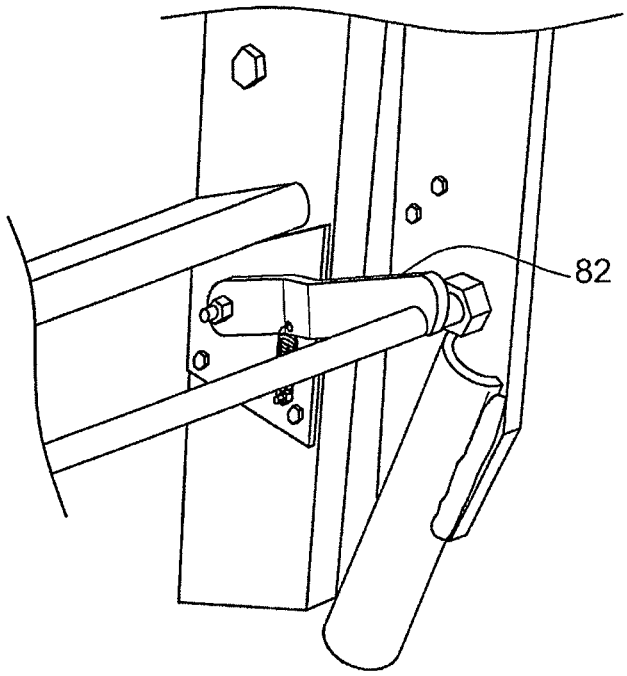
FIG. 10 shows the safety latch mechanism.

As seen in FIGS. 1-5 and 11A-E, each of the rails 22, 24 includes a bend 64, 66 near the point where the rails 22, 24 are connected to ladder rails 40, 42. The bends 64, 66 allow for the ladder system 20 to lay flush, or substantially parallel, to the existing ladder, when in a closed position. In a preferred embodiment, the bends 64, 66 in rails 22, 24 are approximately 45 degrees off the rails' 22, 24 center line(s). The length and angle of the bent portion may however be adjusted based on the application, length and shape of the ladder system 20 or rails 22, 24. Referring to FIG. 10, the ladder system may be locked in the closed position using the safety latch 82 which locks the ladder system 20 to the ladder being stabilized. The safety latch can be used with a plurality of ladders, including but not limited to pull-down ladders, straight ladders and extension ladders. FIG. 10 shows the safety latch 82 attached to the lateral cross member strut 26, however in another embodiment, the safety latch 82 may attach to a loop or other latch receptacle.

The ladder system 20 structure as described can be constructed from any material known in the art of ladder fabrication, including but not limited to wood, metal, metal alloys, fiberglass, composites, carbon fiber, plastic or a combination thereof. Similarly, the rails of the smaller strut section or ladder system 20 need not be the same material as the larger ladder section. In certain embodiments, each of the ladder system rails 22, 24 may be constructed from a single, continuous material (e.g., a singular, unbroken material). By constructing the rails 22, 24 from a single, continuous material, fewer connection points (e.g., welds/joints) are needed, thereby decreasing costs while also strengthening the rails 22, 24. For example, each rail may be constructed from a single length of metal or metal alloy which may be cut, molded or stamped in the shape of the support rail. The ladder system 20 may also include a kick peg 74 mounted on one or both of the ladder system rails 22, 24 or other stable ladder system 20 surface. The kick peg 74 allows for easy employment of the ladder system because the user is able to spread the ladder system away from the existing ladder using only a foot.

While the present invention has been described with respect to what are currently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation, so as to encompass all such modifications and equivalent structures and functions.

All U.S. and foreign patent documents, all articles, all brochures and all other published documents discussed above are hereby incorporated by reference into the Detailed Description of the Preferred Embodiment.

What is claimed is:

1. A method for stabilizing a ladder, comprising:

connecting first and second support rails using one or more longitudinal cross members such that the first and second support rails are substantially parallel, wherein each support rail has a first distal end, a second distal end, and an adjustable shaft located at the second distal end, wherein each of said first and second support rails is a continuous length of flat material having a bend positioned between said first distal end and said second distal end, wherein the bend divides the continuous length of flat material to define (i) a first substantially linear portion between said first distal end and the bend, and (ii) a second substantially linear portion between said second distal end and the bend, wherein said first substantially linear portion and said second substantially linear portion are positioned in substantially the same plane and positioned at an obtuse angle relative to one another;

inserting a rod through a hollow ladder rung situated at, or below, a longitudinal midpoint of the ladder, wherein the longitudinal midpoint is the point equidistant from the base end and upper end of the ladder when the ladder is fully extended, such that the rod's first and second ends protrude from each side of the hollow ladder rung;

pivotally connecting the first distal end of the first parallel support rail to the first end of said rod such that the first substantially linear portion of the first parallel support rail extends to achieve a substantially perpendicular angle in relation to the ladder rails;

pivotally connecting the first distal end of the second parallel support rail to the second end of said rod such that the first substantially linear portion of the second parallel support rail to achieve a substantially perpendicular angle in relation to the ladder rails; and connecting one or more spreaders between said first and second support rails and one or more ladder rails.

2. The method of claim 1, wherein said adjustable shaft is spring-loaded.

3. The method of claim 1, wherein each of said first and second parallel support rails comprises an adjustable shaft at the second distal end of each support rail, said adjustable shaft having a shoe at the ground contact point, wherein said shoe has a gripping material to prevent slippage at the ground contact point.

4. An apparatus for stabilizing a ladder, the ladder having a first side rail and second side rail, each of said first and second side rails having an inner surface, an outer surface defining a surface plane, a base end, an upper end, and a hollow ladder rung joining the inner surface of the first side rail to the inner surface of the second side rail at, or below, a longitudinal midpoint of the rails and disposed to lie generally perpendicular to said first and second side rails, the apparatus comprising:

(i) first and second support rails adapted for pivotal connection to said first and second side rails, wherein each of said first and second support rails is a continuous length of flat material having a first distal end, a second distal end, and a bend positioned between said first distal end and said second distal end, wherein the bend divides the continuous length of flat material to define (i) a first substantially linear portion between said first distal end and the bend, and (ii) a second substantially linear portion between said second distal end and the bend, wherein said first substantially linear portion and said second substantially linear portion are positioned in substantially the same plane and positioned at an obtuse angle relative to one another;

(ii) a rod for pivotally attaching the first distal end of each of said first and second support rails to the ladder, wherein said rod, which has a first rod end and a second rod end, is configured to be inserted through said hollow ladder rung such that the first and second rod ends protrude on each side of said hollow ladder rung, thereby enabling the first distal end of each of said first and second support rails to be removably attached to said ladder, wherein said first support rail is configured to selectively extend from the base end of the first side rail, said first support rail selectively extending in a plane that is substantially parallel to the first side rail's surface plane, wherein said second support rail is configured to selectively extend from the base end of the second side rail, said second support rail selectively extending in a plane that is substantially parallel to the second side rail's surface plane;

(iii) a spreader having a first spreader end and a second spreader end, said spreader being configured to fold at a point between said first spreader end and said second spreader end, wherein the first spreader end of said spreader is pivotally connected to the first support rail and the second end is configured to be attached to said ladder, wherein full extension of the spreader aligns the first support rail such that the first substantially linear portion of the first support rail is positioned at a substantially perpendicular angle relative to the length of the first side rail; and (iv) a shoe coupled to the second distal end of each of said first and second support rails, and located at a ground contact point.

5. The apparatus of claim 4, further comprising a second rod for pivotally attaching the second end of each spreader to a second hollow ladder rung coupled to the ladder.

6. The apparatus of claim 4, further comprising an adjustable shaft at each second distal end of each support rail that couples said second distal end to the shoe at the ground contact point.

7. The apparatus of claim 6, wherein each shoe has a gripping material to prevent slippage at the ground contact point.

8. The apparatus of claim 6, wherein said adjustable shaft is spring-loaded.

9. The apparatus of claim 4, wherein each of said first and second support rails is constructed from a single, continuous material.

10. The apparatus of claim 4, wherein each of said first and second support rails is constructed from a metal or metal alloy.

11. The apparatus of claim 4, further comprising a kick peg.

12. A ladder system, comprising:

(i) a first side rail and second side rail, each of said first and second side rails having an inner surface, an outer surface defining a surface plane, a base end, and an upper end;

(ii) a hollow ladder rung, said hollow ladder rung configured to join the inner surface of the first side rail to the inner surface of the second side rail at, or below, a longitudinal midpoint of the rails and disposed to lie generally perpendicular to said first and second side rails;

(iii) first and second support rails adapted for pivotal connection to said first and second side rails, wherein each of said first and second support rails is a continuous length of flat material having a first distal end, a second distal end, and a bend positioned between said first distal end and said second distal end, wherein the bend divides the continuous length of flat material to define (i) a first substantially linear portion between said first distal end and the bend, and (ii) a second substantially linear portion between said second distal end and the bend, wherein said first substantially linear portion and said second substantially linear portion are positioned in substantially the same plane and positioned at an obtuse angle relative to one another;

(iv) a rod for pivotally attaching the first distal end of each of said first and second support rails to the ladder, wherein said rod, which has a first rod end and a second rod end, is configured to be inserted through said hollow ladder rung such that the first and second rod ends protrude on each side of said hollow ladder rung, thereby enabling the first distal end of each of said first and second support rails to be removably attached to said ladder, wherein said first support rail is configured to selectively extend from the base end of the first side rail, said first support rail selectively extending in a plane that is substantially parallel to the first side rail's surface plane, wherein said second support rail is configured to selectively extend from the base end of the second side rail, said second support rail selectively extending in a plane that is substantially parallel to the second side rail's surface plane;

(v) a spreader having a first spreader end and a second spreader end, said spreader being configured to fold at a point between said first spreader end and said second spreader end, wherein the first spreader end of said spreader is pivotally connected to the first support rail and the second end is configured to be attached to said ladder, wherein full extension of the spreader aligns the first support rail such that the first substantially linear portion of the first support rail is positioned at a substantially perpendicular angle relative to the length of the first side rail; and (vi) a shoe coupled to the second distal end of each of said first and second support rails, and located at a ground contact point.

13. The system of claim 12, further comprising a second rod for pivotally attaching the second end of each spreader to a second hollow ladder rung coupled between said first side rail and second side rails.

14. The system of claim 12, wherein each of said first and second support rails is constructed from a single, continuous material.

15. The system of claim 12, wherein said first and second support rails are constructed from a metal or metal alloy.

16. The system of claim 12, wherein said shoe has a gripping material to prevent slippage at the ground contact point.

17. The system of claim 12, further comprising an adjustable shaft at each second distal end of each support rail that couples said second distal end to the shoe at the ground contact point, wherein said adjustable shaft includes two or more notches for adjusting the height of the shaft.

18. The system of claim 12, further comprising a kick peg.

* * * * *